US008807116B2

(12) United States Patent
Stucchi et al.

(10) Patent No.: US 8,807,116 B2
(45) Date of Patent: Aug. 19, 2014

(54) HIGH OPERATION REPEATABILITY AND STABILITY FUEL INJECTION SYSTEM FOR AN INTERNAL COMBUSTION ENGINE

(75) Inventors: Sergio Stucchi, Valenzano (IT); Onofrio De Michele, Valenzano (IT); Raffaele Ricco, Valenzano (IT); Domenico Lepore, Valenzano (IT); Chiara Altamura, Valenzano (IT); Marcello Gargano, Valenzano (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 487 days.

(21) Appl. No.: 13/142,792

(22) PCT Filed: Dec. 29, 2009

(86) PCT No.: PCT/IB2009/007907

§ 371 (c)(1),
(2), (4) Date: Oct. 25, 2011

(87) PCT Pub. No.: WO2010/076645

PCT Pub. Date: Jul. 8, 2010

(65) Prior Publication Data

US 2012/0035832 A1 Feb. 9, 2012

(30) Foreign Application Priority Data

Dec. 29, 2008 (EP) ..... 08425817

(51) Int. Cl.
*F02B 3/00* (2006.01)

(52) U.S. Cl.
USPC ..... 123/300; 123/299; 701/104

(58) Field of Classification Search
USPC ..... 123/472–494, 299; 701/104
See application file for complete search history.

(56) References Cited

U.S. PATENT DOCUMENTS

| | | | | |
|---|---|---|---|---|
| 5,499,608 | A | 3/1996 | Meister et al. | |
| 6,415,762 | B1 | 7/2002 | Hafner et al. | |
| 7,191,765 | B2 * | 3/2007 | Santero | 123/490 |
| 7,240,859 | B2 * | 7/2007 | Ricco et al. | 239/585.1 |
| 7,296,555 | B2 * | 11/2007 | Tamma et al. | 123/304 |
| 2002/0185112 | A1 * | 12/2002 | Lei | 123/446 |
| 2010/0162992 | A1 * | 7/2010 | Ricco et al. | 123/299 |
| 2010/0186708 | A1 * | 7/2010 | Ricco et al. | 123/299 |
| 2011/0192372 | A1 * | 8/2011 | Guglielmone et al. | 123/294 |
| 2011/0197851 | A1 * | 8/2011 | Parrish et al. | 123/299 |

FOREIGN PATENT DOCUMENTS

| | | |
|---|---|---|
| DE | 196 36 088 | 3/1998 |
| DE | 198 09 001 | 9/1998 |
| DE | 10 2004 050992 | 4/2006 |

(Continued)

*Primary Examiner* — Thomas Moulis
*Assistant Examiner* — Joseph Dallo
(74) *Attorney, Agent, or Firm* — Berenato & White, LLC

(57) ABSTRACT

A fuel injection system for an internal combustion engine, comprising: at least one fuel electroinjector; and one electronic control unit designed to supply the fuel electroinjector, in a fuel injection phase in an engine cylinder, with at least a first electrical command to perform a pilot fuel injection, and a second electrical command to perform a main fuel injection. The first and second electrical commands are separated in time by an electrical dwell time such that the main fuel injection starts without interruption with respect to the pilot fuel injection. The electrical dwell time between the first and second electrical commands belongs to an electrical dwell time range in which the total fuel amount injected in the pilot and main fuel injections in a fuel injection phase in an engine cylinder is substantially constant.

15 Claims, 4 Drawing Sheets

(56) References Cited

FOREIGN PATENT DOCUMENTS

| | | |
|---|---|---|
| EP | 1 302 654 | 4/2003 |
| EP | 1 657 422 | 5/2006 |
| EP | 1 707 797 | 10/2006 |
| EP | 1 795 738 | 6/2007 |
| EP | 1 918 568 | 5/2008 |

* cited by examiner

HIGH OPERATION REPEATABILITY AND STABILITY FUEL INJECTION SYSTEM FOR AN INTERNAL COMBUSTION ENGINE

TECHNICAL FIELD OF THE INVENTION

The present invention relates to a high operation repeatability and stability fuel injection system for an internal combustion engine.

BACKGROUND ART

Typically, fuel injection systems comprise a plurality of fuel electroinjectors, each provided with a metering servo valve comprising a control chamber supplied with pressurized fuel and provided with a fuel outlet normally closed by an open/close element via elastic urging means. The open/close element is operated to open the fuel outlet of the control chamber by an electric actuator acting in opposition to the elastic urging means to cause fuel to be injected. The fuel pressure in the control chamber acts on a control rod axially movable in the injector body, which control rod engages with a nebulizer needle axially mobile to open and close fuel injection holes in a nebulizer nozzle.

The fuel injection system further comprises an electronic control unit programmed to supply the electric actuators, for each fuel injection, with a corresponding electrical command. The time delay of the movement of the control rod with respect to the corresponding electrical command depends upon the pre-loading of the urging means that act on the open/close element of the metering servo valve, as well as upon the volume of the control chamber and upon the ratio between the sections of the fuel inlet and outlet thereof.

In order to improve engine performance, from EP 1657422 and EP 1795738 a fuel injection system is known in which, in predefined engine operating conditions (based on the engine speed, load, coolant temperature, etc.), the electronic control unit supplies, in a fuel injection phase and in the corresponding fuel combustion phase in an engine cylinder, at least a first electrical command of a predetermined time duration to perform a pilot fuel injection, and a subsequent electrical command of a time duration depending upon the engine operating conditions to perform a main fuel injection. The two electrical commands are separated in time by an electrical dwell time such that the main fuel injection starts without interruption with respect to the pilot fuel injection, i.e., the instantaneous fuel flow-rate during the fuel injection phase assumes a so-called "two-hump profile".

OBJECT AND SUMMARY OF THE INVENTION

The Applicant has experimentally found that, in the fuel injection systems described in the aforementioned patents, once the time durations of the electrical commands for the pilot and main fuel injections, fuel pressure and the fuel amount injected during the pilot fuel injection, generally expressed in volume, have been fixed based on the engine operating conditions, the total fuel amount injected as a whole into an engine cylinder via the pilot and main fuel injections varies as a function of the electrical dwell time between the corresponding electrical commands issued by the electronic control unit. In particular, two different behaviours of the fuel eiectroinjector have been identified as a function of the electrical dwell time between the electrical commands for the pilot and main fuel injections. In fact, it is possible to identify a limit electrical dwell time, above which the fuel amount injected during the main fuel injection depends not only upon the time duration of the corresponding electrical command, but also upon the fuel pressure and upon the fuel amount injected during the pilot fuel injection, which are preset quantities, as well as upon the fuel pressure oscillations that are set up in the fuel delivery pipe via which fuel is delivered to the fuel electroinjector and that are caused by the pilot fuel injection.

For electrical dwell times between the electrical commands for the pilot and main fuel injections shorter than this limit electrical dwell time, the fuel amount injected during the main fuel injection is affected, instead, by numerous factors in addition to the ones described previously, namely, the fuel pressure and the fuel amount injected during the pilot fuel injection, i.e., the electrical dwell time between the two electrical commands, the rebounds of the open/close element on the valve seat during closing of the fuel outlet of the control chamber, which rebounds re-open the fuel outlet of the control chamber and affect the evolution of the fuel pressure in the control chamber and hence affect the dynamics of the control rod controlled thereby, the nebulizer needle position at start of the electrical command for the main fuel injection, and also the fluid-dynamic conditions that are set up in the proximity of the fluid-tight area of the open/close element of the metering servo valve.

In addition, it is necessary to take into account also the fuel electroinjector age in so far as the wear of the fluid-tight parts or of the relatively movable parts with extremely small clearance, significantly affects the open/close element bouncing, whilst the so-called "coking" phenomenon, which affects the nebulizer nozzle holes and which basically consists in the progressive narrowing of the hole section caused by precipitation of carbon deposits generated by the combination of the high fuel injection pressure with the high temperatures in the combustion chamber, reduces the sections of the latter, accordingly reducing the fuel flow-rate of the fuel electroinjector.

As has been said, the pilot fuel injection in effect alters the fluid-dynamic conditions of the fuel electroinjector when the electrical command for the main fuel injection is supplied. In particular, for fuel amounts injected during the pilot fuel injection in the region of 1-3 $mm^3$, which are typical in applications on passenger motor vehicle engines, and of 5-7 $mm^3$, which are typical in applications on industrial motor vehicle engines, the limit electrical dwell time between the electrical commands for the pilot and main fuel injections which separates these two behaviours is approximately 300 μs.

The Applicant has moreover experimentally found that the operation robustness of a fuel electroinjector is markedly jeopardized when the electrical dwell time between the electrical commands for the pilot and main fuel injections is shorter than the aforesaid limit electrical dwell time, and in particular when the electrical dwell time becomes very short so that the pilot fuel injection interferes to a greater extent with the subsequent main fuel injection.

Even though it is possible to program the electronic control unit so as to vary, during the fuel electroinjector service life, the electrical dwell time between the electrical commands for the pilot and main fuel injections, it is in any case impossible to predetermine the amount of the correction to be introduced to cause the instantaneous fuel flow-rate during the pilot and main fuel injections to continue to have a two-hump profile. In particular, it is impossible to keep the predefined ratio between the fuel amounts injected during the pilot and main fuel injections unvaried, and as it varies it is possible to arrive at a limit situation where there is the substantial merging of the two fuel injections into a single fuel injection, associated to which is the introduction into the combustion chamber of an excessive fuel amount which adversely affects the engine exhaust gas emissions.

In fact, the drawback that is experienced in known fuel injection systems of the type described is due to the fact that, to obtain a two-hump profile of the instantaneous fuel flow-rate during the pilot and main fuel injections, with a pilot fuel injection, albeit contiguous, in any case well identified and distinguishable from the main fuel injection, it is necessary to set a very short electrical dwell time between the corresponding electrical commands. Consequently, start of re-opening of the metering servo valve to obtain the main fuel injection occurs when the fluid-dynamic conditions are markedly variable and depend upon the parameters referred to previously, with deleterious effects on the engine efficiency and on the pollutant exhaust gas emissions.

The above drawbacks increase rapidly during the fuel electroinjector service life: in particular, the wear of the relatively movable components in the fuel electroinjector and phenomena such as coking of the nebulizer nozzle holes alter the electroinjector performance curves, such as the so-called "fuel flow-rate curves", which depict the fuel amount injected during the main fuel injection versus the time duration of the corresponding electrical command, for a fixed fuel pressure, or the so-called "approach curves", which will be described more fully hereinafter, which depict the total fuel amount injected as a whole during a pilot fuel injection and a subsequent main fuel injection versus the electrical dwell time between the corresponding electrical commands, for given fuel pressure and time durations of the electrical commands. Since the electrical commands issued by the electronic control unit are based upon the aforesaid performance curves of the fuel electroinjector, and since it is impossible to foresee exactly the way in which they vary in time as a result of wear or coking, it is rather difficult to work out a control algorithm that will enable the electronic control unit to guarantee robust operation that is reproducible from one fuel electroinjector to another during the entire service life of a fuel electroinjector. In particular, it is not possible to resort to a UEGO probe for the continuous correction of the mapping of each individual fuel electroinjector in so far as this is located downstream of the exhaust manifolds of all the engine cylinders and hence will analyse the average exhaust gas emissions. In order to comply with the new and severe limits on exhaust gas emissions, such a countermeasure is not sufficient also because, in the first place, the performance curves of one fuel electroinjector are not perfectly superimposable on those of another; in addition, as has been said previously, in the operating range in question, even minimal variations in the electrical dwell time between the electrical commands for the pilot and main fuel injections result in significant differences in the fuel electroinjector operation.

The aim of the present invention is to provide a common rail fuel injection system with high operation repeatability and stability over time, thus eliminating the drawbacks of fuel injection systems according to the state of the art.

According to the present invention, the above aim is achieved by a common rail fuel injection system for an internal combustion engine, as defined in the annexed claims.

BRIEF DESCRIPTION OF THE DRAWINGS

For a better understanding of the present invention some preferred embodiments thereof are described herein, purely by way of example and with the aid of the annexed drawings, wherein.

DETAILED DESCRIPTION OF PREFERRED EMBODIMENTS OF THE INVENTION

Figure 1:
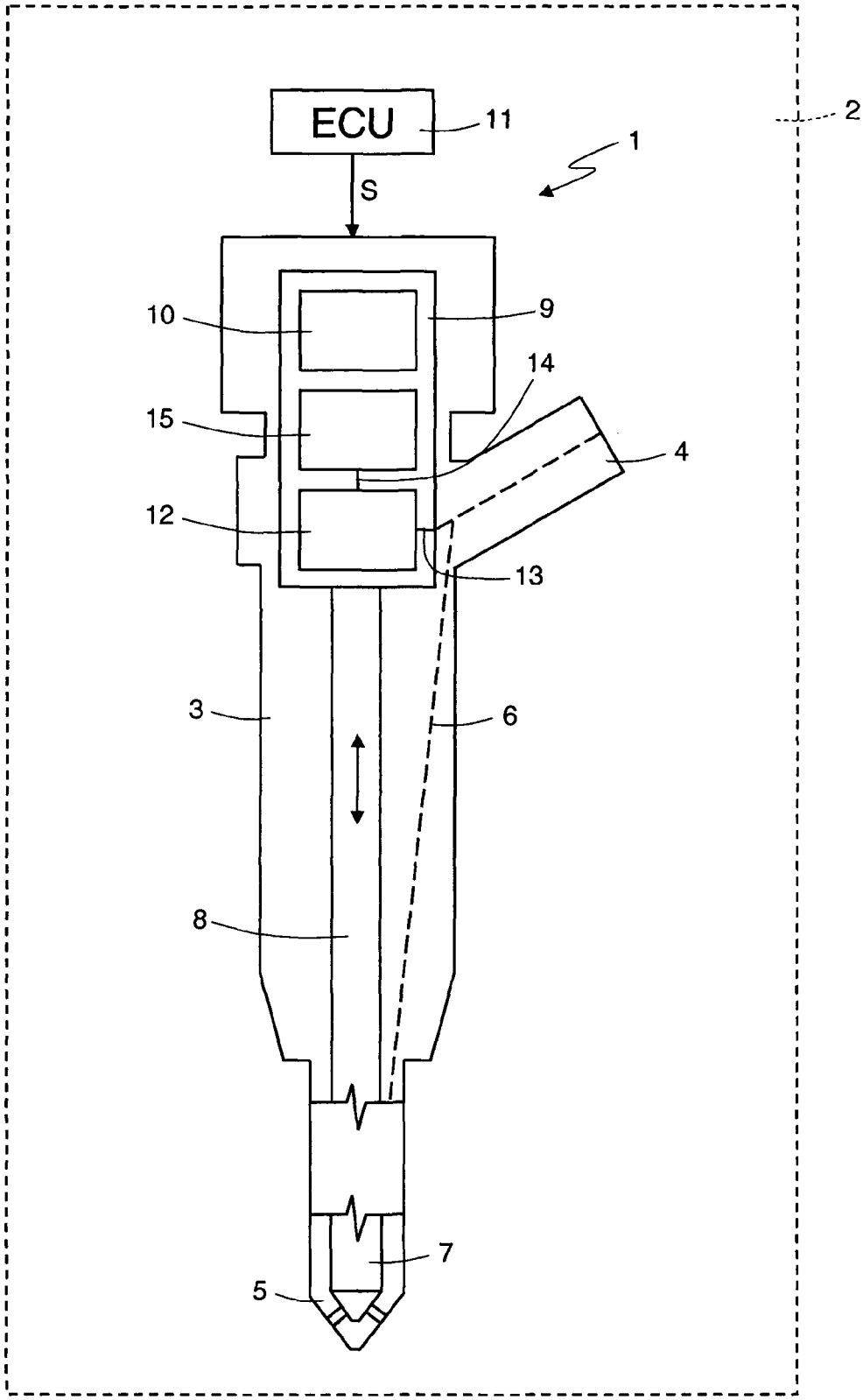
FIG. 1 schematically shows a fuel electroinjector for a fuel injection system for an internal combustion engine.

In FIG. 1 designated as a whole by 1 is a fuel electroinjector for a high pressure fuel injection system 2, in particular a common rail fuel injection system, for an internal combustion engine (not shown), in particular a diesel engine.

The fuel electroinjector 1 comprises a hollow injector body 3, which extends along a longitudinal axis and has a lateral fuel inlet 4 designed to be connected, by means of a high pressure fuel delivery pipe, to a common rail, which is in turn connected to a high pressure pump (not shown) of the fuel injection system 2. The injector body 3 ends with a nebulizer 5, which basically comprises a nozzle 5, which communicates with the fuel inlet 4 through a pipe 6 and has a conical tip provided with fuel injection holes. The nozzle is normally kept closed by a needle shutter 7 having a conical tip, which is designed to engage the conical tip of the nozzle and is axially movable within the nebulizer to open and close the nozzle holes under the action of a control rod 8, which is axially movable in the bottom part of the injector body 3 in a different embodiment, the needle shutter 7 is made of a single piece with the control rod 8, which, consequently, opens and closes the nozzle holes directly.

In the top part of the injector body 3 a fuel metering servo valve 9 is housed, which is operable to control the movement of the control rod 8. The metering servo valve 9 comprises an electric actuator 10 controlled by an electronic control unit 11 programmed to supply the electric actuator 10, for each fuel, injection phase and corresponding fuel combustion cycle in an engine cylinder, with one or more electrical commands to perform corresponding fuel injections. In the present description and in the claims, by the term "electrical command" is meant as an electric current signal having a predetermined time duration and a predetermined time evolution.

The metering servo valve 9 further comprises a control chamber 12 that communicates permanently with the fuel inlet 4 through a fuel inlet passage 13 and with a fuel discharge (not shown) through a fuel outlet passage 14, which is opened and closed by a shutter 15 that co-operates with a corresponding valve seat, in which the outlet passage 14 is arranged, to fill or empty the control chamber 12 and thus cause the control rod 8 to perform axial opening and closing strokes in response to a reduction or an increase in the fuel pressure in the control chamber 12, thus determining opening and closing of the nebulizer 5 and hence fuel injection or otherwise into the respective engine cylinder.

The metering servo valve 9 may be either of the type with solenoid electric actuator 10 or of the type with piezoelectric electric actuator 10, as well as it may be either of the type with a so-called "unbalanced" hydraulic architecture, where the shutter 15 is subjected, when closing the fuel outlet passage 14, to the opposite actions of the fuel pressure on one side and of urging means, generally formed by a spring, on the other side, or with a so-called "balanced" hydraulic architecture, where the shutter 15 is subjected, when closing the fuel outlet passage 14, just to the action of the urging means in so far as the axial urging exerted by the fuel on the shutter 15 is substantially zero.

From EP 1106816 is for example known a metering servo valve with a solenoid electric actuator and an unbalanced hydraulic architecture, wherein the valve seat is formed by a conical seat where a calibrated portion of the fuel outlet passage of the control chamber gives out, while the shutter is formed by a ball controlled by a stem sliding in a sleeve under the action of the electric actuator.

From the aforementioned EP 1795738 and from EP 1621764 is instead known a metering servo valve with a solenoid electric actuator and a balanced hydraulic architecture, wherein the shutter is formed by a sleeve axially slidable in a fluid-tight manner on an axially fixed stem, where the fuel outlet passage is arranged, while the valve seat is formed by an annular shoulder defined by a connection area between the stem and a flange, which is made of a single piece with the stem and from which the stem protrudes, and which is housed in the injector body and is kept axially in contact, in a fluid-tight manner, against a shoulder of the injector body by a threaded ringnut screwed on an internal thread.

A metering servo valve with a solenoid actuator and a balanced hydraulic architecture different from the one illustrated in the two aforementioned patents is, for example, known from WO2009092507 and WO2009092484.

From EP 1612398 and WO2008138800 is instead known a metering servo valve with a piezoelectric electric actuator and a balanced hydraulic architecture, wherein the shutter is formed by a stem axially slidable in a fluid-tight manner on an axially fixed sleeve, while the valve seat is formed by an annular shoulder of the sleeve.

In order to obtain a high engine efficiency and to reduce the pollutant exhaust gas emissions, for each fuel combustion cycle in an engine cylinder, the electronic control unit 11 is programmed to control the metering servo valve 9 in such a way that the fuel electroinjector 1 performs a fuel injection phase comprising at least a pilot fuel injection and a subsequent main fuel injection, which starts without interruption with the pilot fuel injection.

For said purpose, in each fuel injection phase in an engine cylinder, the electronic control unit 11 is programmed to generate at least a first electrical command $S_1$ with a predetermined time duration to operate the electric actuator 10 and thus the shutter 15 and cause the control rod 8 to perform a first opening stroke, followed by a corresponding first closing stroke, in order to carry out the pilot fuel injection, and a second electrical command $S_2$ with a time duration that is a function of the engine operating conditions to operate the electric actuator 10 and thus the shutter 15 and cause the control rod 8 to perform a second opening stroke, followed by a corresponding second closing stroke, in order to carry out the main fuel injection. The two electrical commands $S_1$ and $S_2$ are separated in time by an electrical dwell time, designated by DT, the role of which in determining the operation stability and robustness of the fuel electroinjector 1 will be discussed in greater detail hereinafter.

The fuel amount $V_P$ injected during the pilot fuel injection is substantially independent of the fuel pressure and is proportional to the cylinder combustion chamber volume. In particular, in applications on passenger motor vehicle engines, the fuel amount injected during the pilot fuel injection is in the region of 1-3 $mm^3$, whereas in applications on industrial motor vehicle engines the value increases up to 5-7 $mm^3$.

The fuel amount $V_M$ injected during the main fuel injection depends, instead, not only upon the displacement of the engine cylinder, but also upon the engine operation point, defined by engine speed and load, and increases starting from a minimum value of 5 $mm^3$, which it assumes during idling, up to a maximum value in the region of 55 $mm^3$ (for a displacement of the engine cylinder of approximately 330 cc) or of 70 $mm^3$ (for a displacement of the cylinder of approximately 500 cc), which it assumes during maximum torque, i.e., between 1900 and 2300 r.p.m.

Figure 2:
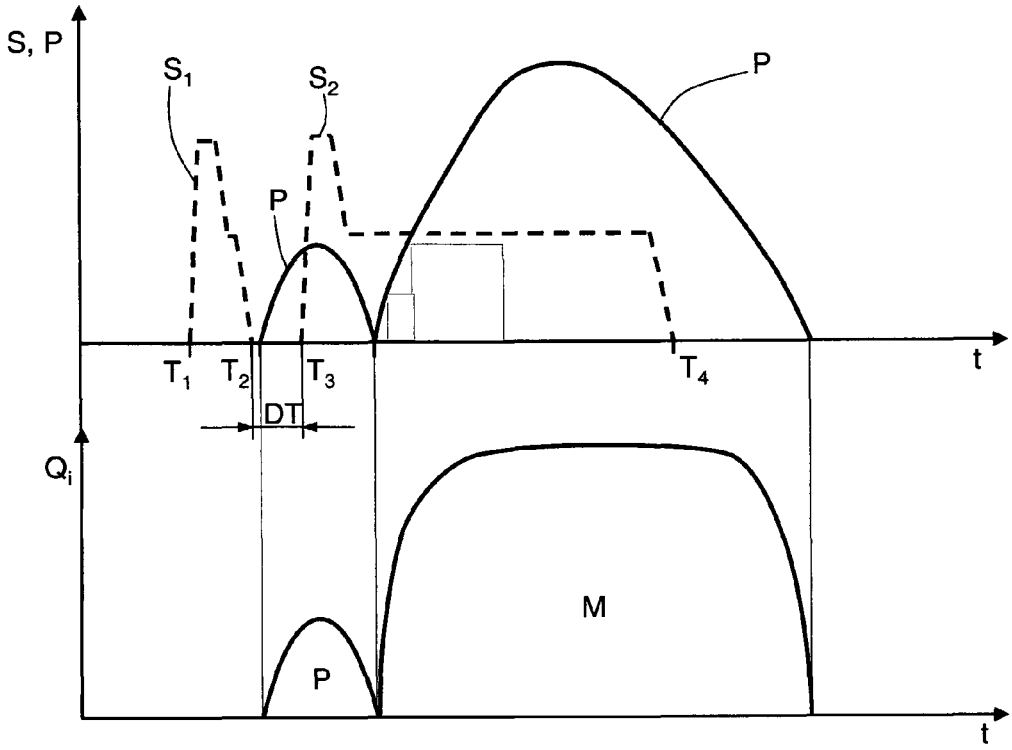
FIGS. 2 to 6 show diagrams depicting evolutions of physical quantities in a fuel injection system.

FIG. 2 shows a top graph where the time evolution of the electrical commands $S_1$ and $S_2$ for the pilot and main fuel injections supplied by the electronic control unit 11 are depicted with a dashed line, while the corresponding displacement P of the control rod 8 in response to the electrical commands $S_1$ and $S_2$, with respect to the ordinate "zero", in which the nebulizer 5 is closed, is depicted with a solid line. In addition, FIG. 2 shows a bottom graph where the time evolution of the instantaneous fuel flow-rate $Q_i$ injected into an engine cylinder during the pilot and main fuel injections, designated by P and M, respectively, and corresponding to the displacement P of the control rod 8 is depicted.

In the bottom graph of FIG. 2 it may be appreciated that the pilot and main fuel injections are contiguous in time, or, from a different standpoint, are separated by a hydraulic dwell time that is substantially zero, which allows a two-hump profile of the instantaneous fuel flow-rate $Q_i$ to be achieved, which in turn allows given benefits in terms of operation stability and robustness of the electroinjector 1 to be achieved, as will be discussed more fully in what follows.

In the top graph of FIG. 2 it may be appreciated that the first electrical, command $S_1$ for the pilot fuel injection is generated and then supplied to the fuel electroinjector 1 starting from a time instant designated by $T_1$ and has an evolution with a rising stretch having a relatively fast growth up to a maximum value in order to energize the electric actuator 10, which is then followed by an excitation maintenance stretch with a value lower than the maximum value, which is finally followed by a final decrease stretch that terminates at the time instant designated by $T_2$.

The second electrical command $S_2$ is generated and then supplied to the fuel electroinjector 1 starting from a time instant designated by $T_3$ and such that the control rod 8 starts the corresponding opening stroke not after it has reached the end of the closing stroke consequent upon the first electrical command $S_1$, giving thus rise to a main fuel injection that starts without interruption with the pilot fuel injection. In particular, in order to obtain exactly the two-hump profile of the instantaneous fuel flow-rate $Q_i$ shown in the bottom diagram of FIG. 2, the time instant $T_3$ is such that the control rod 8 starts the opening stroke consequent upon the second electrical command $S_1$ exactly at the time instant in which it reaches the end of the closing stroke consequent upon the first electrical command $S_1$. A displacement without any interruption identical to that of the control rod 8 is performed also by the needle 7 on which the control rod 8 acts, thus determining a closing of the nebulizer nozzle holes for a substantially zero time, corresponding to which is a hydraulic dwell time between the pilot and main fuel injections that is also substantially zero.

The time interval $T_3$-$T_2$ defines, instead, the aforementioned electrical dwell time DT between the two electrical commands $S_1$ and $S_2$.

The second electrical command $S_2$ also has a time evolution with a rising stretch up to a maximum value, in order to energize the electric actuator 10, followed by an excitation maintenance stretch with a value lower than the maximum value and time duration longer than that of the excitation maintenance stretch of the first electrical command $S_1$ and variable as a function of the engine operating conditions. Finally, the excitation maintenance stretch of the second electrical signal $S_2$ is followed by a final decrease stretch, which terminates at the time instant, designated by $T_4$.

Given that the fuel amount to be injected during the main fuel injection is higher than the one to be injected during the pilot fuel injection, during the main fuel injection the control rod 8 performs an opening stroke longer than the opening stroke that it performs during the pilot fuel injection, and, especially during full-load engine operating conditions, it reaches its maximum lift. In other words, during the pilot fuel injection, the motion of the control rod 8 occurs in so-called "ballistic" conditions, whereas, during the main fuel injection, the control rod 8 reaches a maximum lift also to favour robustness and repeatability of the main fuel injection.

Figure 3:
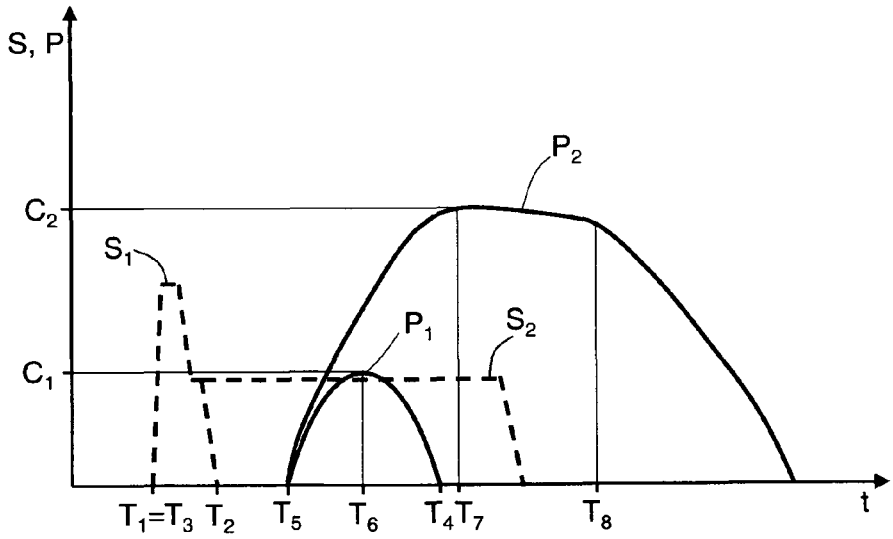

For a better understanding of what has been said above, FIG. 3 shows the comparison between a pilot fuel injection and a main fuel injection considered separately, i.e., not forming part of a succession of fuel injections. In particular, in FIG. 3 the curves designated by $P_1$ and $P_2$ show the displacements over time t of the control rod 8 during the pilot and main fuel injections, respectively, in response to respective electrical commands designated by $S_1$ and $S_2$, which are similar those shown in FIG. 2 and which, for convenience of depiction, are shown as starting in the same time instant $T_1$. As it may be appreciated, whereas during the pilot fuel injection the motion of the control rod 8 is of a ballistic type, with a lift, designated by $C_1$, being reached at the time instant $T_6$, during the main fuel injection the control rod 8 reaches a lift designated by $C_2$ at the time instant $T_7$ which remains constant up to the time instant $T_8$, in which the closing stroke starts. It may be further appreciated how the time interval $T_1$-$T_2$, which corresponds to the time duration of the first electrical command $S_1$, is shorter than the time interval $T_5$-$T_6$, which corresponds to the opening stroke of the control rod 8 consequent upon the first electrical command $S_1$, this being indicative that the response of the metering servo valve 9 to an electrical command is faster than that of the control rod 8.

The fuel electroinjectors described in the above-referenced patents are all characterized by metering servo valves having a very fast response to the electrical commands, in particular those with a very small control chamber. The Applicant has experimentally found that in this type of fuel electroinjectors, by displacing the control rod 8 with electrical commands $S_1$ and $S_2$ spaced apart in time by an electrical dwell time DT such that the main fuel injection starts without interruption with the pilot fuel injection, determining, as particular case, the two-hump profile of the instantaneous fuel flow-rate $Q_i$ shown in FIG. 2, the other conditions remaining the same, as the electrical dwell time DT between the electrical commands varies, also the fuel amount injected as a whole in each fuel injection phase, i.e., the fuel amount injected as a whole in a pilot fuel injection and in the subsequent main fuel injection, varies significantly.

In particular, as the electrical dwell time DT between the two electrical commands decreases, it may occur that the start of the second electrical command occurs while the control rod is still during its opening stroke determined by the first electrical command. This is a markedly undesirable situation in so far as it entails partial overlapping of the pilot and main fuel injections, which overlapping determines the introduction of a fuel amount in excess with respect to a desired fuel amount, with corresponding unbalancing of the engine operation and worsening of the exhaust gas emissions.

Figure 4:
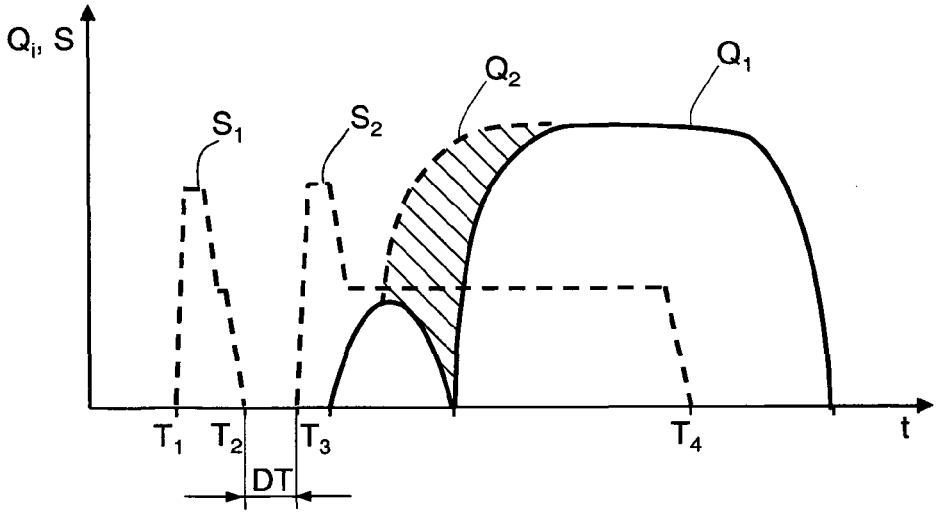

This situation is illustrated in FIG. 4, which comparatively shows, with solid and dashed lines, the time evolutions of the instantaneous fuel flow-rates $Q_1$ and $Q_2$ consequent upon two electrical commands $S_1$ and $S_2$, respectively, spaced apart in time by two different electrical dwell times DT, one longer (solid line) and one shorter, extremely short (dashed line). As it may be appreciated, as the electrical dwell time DT decreases, the time evolution of the instantaneous fuel flow-rate $Q_1$ depicted with a solid line could degenerate into the instantaneous fuel flow-rate $Q_2$ depicted with a dashed line, with consequent injection of a fuel amount in excess with respect to the desired one and represented by the hatched area.

Figure 5:
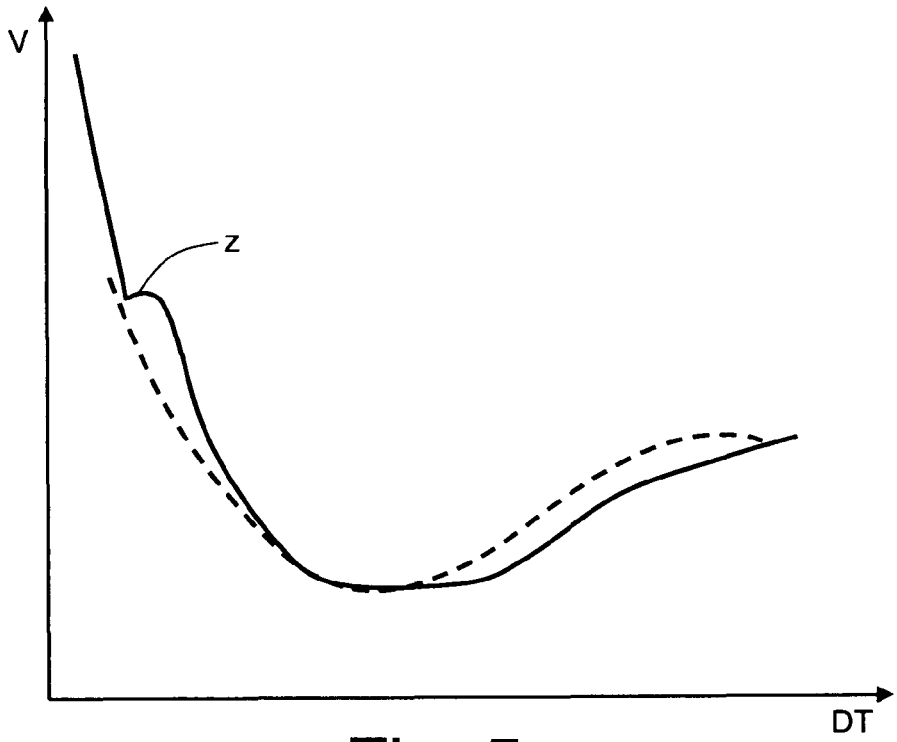

FIG. 5 shows with a solid line the approach curve of a fuel electroinjector and referred to in the introductory part of the description, which is nothing else but the time evolution of the total fuel amount V (generally expressed in units of volume, commonly $mm^3$) injected as a whole in a fuel injection phase comprising a pilot fuel injection and a subsequent main fuel injection that starts without interruption with respect to the pilot fuel injection as a function of the electrical dwell time FT between the corresponding electrical commands $S_1$ and $S_2$ for the pilot and main fuel injections. In particular, the approach curve shown in FIG. 5 has been determined experimentally on a fuel electroinjector with a metering servo valve with a balanced hydraulic architecture of the type described in the aforementioned EP 1795733 and EP 1621764, and in predetermined conditions of fuel pressure and time durations of the electrical commands for the pilot and main fuel injections.

As it may be appreciated from the analysis of the approach curve, for electrical dwell times DT shorter than a certain minimum value and longer than a certain maximum value, in the example considered equal, respectively, 60 μs and 100 μs approximately, the total fuel amount V injected as a whole in the pilot and main fuel injections reduces progressively and rapidly, with a very high and substantially constant gradient, as the electrical dwell time DT increases. Consequently, in these electrical dwell time ranges, an albeit minimum alteration of the approach curve (for example a small horizontal translation) caused by the wear of the parts or the coking phenomenon, results in a significant alteration of the total fuel amount V injected as a whole into an engine cylinder, so that the fuel injection proved to be poorly repeatable.

Instead, for electrical dwell times DT in the intermediate range defined by the aforesaid minimum and maximum values, the variation of the total fuel amount V is much smaller, practically negligible, as compared to the one that instead is obtained for electrical dwell times DT immediately outside the intermediate electrical dwell time range. In particular, in the intermediate electrical dwell time range, the total fuel amount V varies by approximately 3 $mm^3$ on a time basis of 40 μs in applications on passenger motor vehicle engines, whereas it varies by approximately 6 $mm^3$ on a time basis of 60 μs in applications on industrial motor vehicle engines. In this intermediate electrical dwell, time range, consequently, the total fuel amount V has a variation that is at least four times smaller than the variation that is obtained for electrical dwell times DT immediately outside the intermediate electrical dwell time range, so much so chat the total fuel amount is, to a first approximation, substantially constant, so that a possible variation of the electrical dwell time DT within the intermediate electrical dwell time range practically does not alter the total fuel, amount V and hence the operation of the fuel electroinjector 1 proves to have a high repeatability and stability over time.

This substantial constancy or comparatively reduced variability of the total fuel amount of fuel V as the electrical dwell time DT varies in the intermediate electrical dwell time range is depicted in the approach curve shown FIG. 5 with a stretch, designated by Z, which can, to all purposes and effects, be considered approximately horizontal as compared with the slopes of the previous and subsequent stretches.

In addition, the Applicant has experimentally found that it is precisely the intermediate electrical dwell time range in which the total Fuel amount V is substantially constant or has an extremely limited variation that allows the desired two-hump profile of the instantaneous fuel flow-rate $Q_i$ shown in the bottom graph of FIG. 2 to be achieved, rather than the profile of the instantaneous fuel flow-rate $Q_i$ depicted in FIG. 4 with a dashed line, where the pilot fuel injection is in practice indistinguishable from the main fuel injection.

Figure 6:
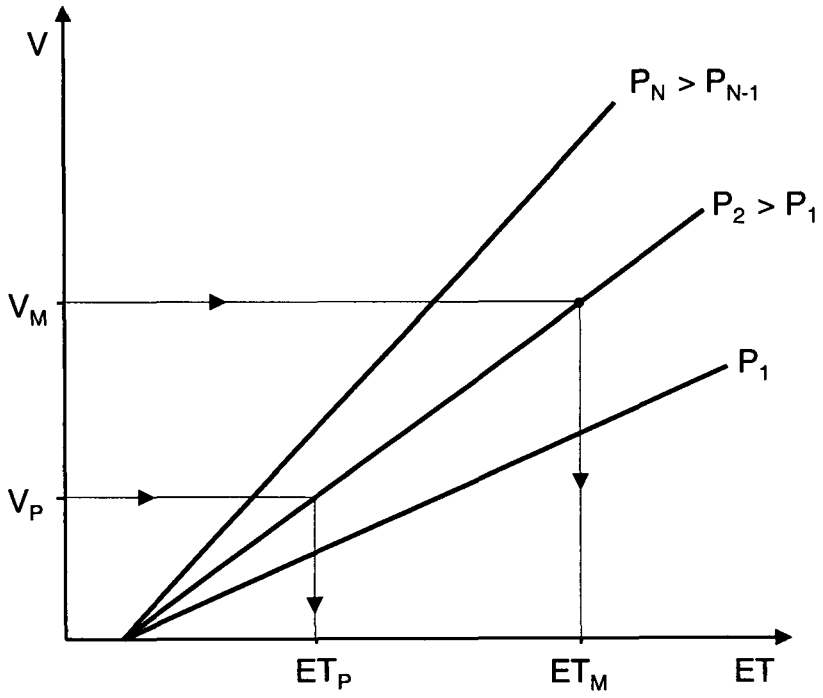

Hence, starting from this experimental finding, once the fuel amounts $V_P$ and $V_M$ so be injected during she pilot and main fuel injections based on the engine operating conditions have been determined, the present invention proposes improving the operation stability and robustness of the fuel injection system 2 through a fuel injection control that basically includes:

characterizing a fuel electroinjector to determine the fuel flow-rate curves at different fuel injection pressures; by way of example, FIG. 6 shows fuel flow-rate curves of a fuel electroinjector and the corresponding fuel injection pressure P, wherein the axis of the ordinates represents the fuel amount V injected by the fuel electroinjector and the axis of the abscissae represents the energization time ET for the fuel electroinjector and which causes it to inject a corresponding fuel amount;

determining, based on the fuel flow-rate curve corresponding to a given fuel injection pressure in the engine operation point in which it is intended to perform a fuel injection phase comprising a pilot fuel, injection followed by a main fuel injection that starts without interruption with the pilot fuel injection, an energization time $ET_P$ for the fuel electroinjector and which causes it to inject the fuel amount $V_P$ desired for the pilot fuel injection, and an energization time $ET_M$ for the fuel injector and which causes it to inject the fuel amount $V_M$ desired for the main fuel injection;

characterizing then the fuel electroinjector for determining the approach curve thereof, using the energization times $ET_P$ and $ET_M$ relating to the pilot and main fuel injections determined at the previous point;

analysing the approach curve to check whether the total fuel amount V injected during the pilot and main fuel injections has, as the electrical dwell time DT between the first and second electrical commands $S_1$, $S_2$ varies in an intermediate electrical dwell time range Z between a first, immediately preceding, electrical dwell time range and a second, immediately subsequent, electrical dwell time range and such that the main fuel injection M starts without interruption with the pilot fuel injection P, a variation that is markedly smaller than that in the first and second electrical dwell time ranges, to such an extent that the total fuel amount can be considered, to a first approximation, substantially constant; in particular, in order for the fuel electroinjector to have the desired operation repeatability and the stability over time, the intermediate electrical dwell time range must conveniently be such that, in relative terms, the total fuel amount V has a variation that is at least four times smaller than those in the first and second electrical dwell time ranges and/or, in absolute terms, the total fuel amount V does not vary more than 3 $mm^3$ on a time basis of 40 μs, in applications on passenger motor vehicle engines, and more than 6 $mm^3$ on a time basis of 60 μs, in applications on industrial motor vehicle engines;

in the case where the check has a positive outcome, choosing a particular electrical dwell time DT between the pilot and main fuel injections within the identified intermediate electrical dwell time range Z, based on the availability of data regarding the way in which the approach curve drifts over time, for example as a result of wear or of the coking phenomenon to which the nebulizer nozzle holes are subject; consequently, if, for example, it is known that, on account of ageing of the parts of the fuel electroinjector, the approach curve tends to shift in time to the right, then it will be expedient to choose an electrical dwell time DT corresponding to the right end of the intermediate electrical dwell time range, whereas in the absence of information on the modes of drifts over time of the approach curve, it will be expedient to choose an electrical dwell time DT corresponding to an intermediate value in the intermediate electrical dwell time range; and, finally storing the chosen electrical dwell, time DT in the electronic control unit 11 in such a way that it will be able to electrically operate the fuel electroinjector 1 in such a way that the latter will perform a pilot fuel injection and a subsequent main fuel injection spaced apart in time by the stored electrical dwell time DT so as to cause the main fuel injection to start without interruption with the pilot fuel injection, and the total fuel amount V injected as a whole during the pilot and main fuel injections is substantially constant around the stored electrical dwell time DT.

The advantages the fuel injection system according to the invention as compared to the known art are evident in view the foregoing. In the first place, the choice of an electrical dwell time DT corresponding to the stretch Z of the approach curve shown in FIG. 5, where the variation of the total fuel amount V is very limited, practically zero with respect to the variations in the stretches before and after the stretch Z, guarantees a high operation repeatability and stability over time of the fuel electroinjector.

It is evident that other modifications and improvements may be made to the fuel injection system described, without thereby departing from the scope of the invention, as defined by the appended claims.

For example, the fuel injection system could have an architecture different from the previously described common rail architecture, in particular of the type described in EP 1612401, EP 1612405 and EP 1612406, where the pressurized fuel storage volume, instead of being defined by a single concentrated common rail, is split into distributed distinct storage volumes, or else of the type used prior to marketing of the common rail architecture, wherein the fuel injectors are directly supplied by a high pressure fuel pump operated in such a way as to deliver pressurized fuel in synchronism with the operation of the fuel injectors, which delivery is, that is, temporally discontinuous, phased with the engine, and cyclically constant.

The invention claimed is:

1. A fuel injection system (2) for an internal combustion engine, for maintaining consistent emission and fuel consumption characteristics despite injection system component wear, comprising:

at least one fuel electroinjector (1); and an electronic control unit (11) designed to supply the fuel electroinjector (1), in a fuel injection phase in an engine cylinder, with at least a first electrical command (S.sub.1) to perform a pilot fuel injection (P), and a second electrical command (S.sub.2) to perform a main fuel injection (M), the first and second electrical commands (S.sub.1, S.sub.2) being separated in time by an electrical dwell time (DT) such that the main fuel injection (M) starts without interruption with respect to the pilot fuel injection (P); wherein the fuel electroinjector (1) is operated such that the total fuel amount (V) injected during the pilot and main fuel injections (P, M) in a fuel injection phase in an engine cylinder remains relatively constant despite system wear, wherein as the electrical dwell time (DT) between the first and second electrical commands (S.sub.1, S.sub.2) varies, so as to adjust total injected fuel volume in accord with predetermined performance data points, the dwell time varies only within an intermediate electrical dwell time range (Z) defined between a first and a second electrical dwell time range, such that the main fuel injection (M) will continue to start without interruption with respect to the pilot fuel injection (P), but also where the total fuel amount (V) variation is smaller than the variation in the first and second electrical dwell time ranges that lie outside of the intermediate range (Z); and wherein the electrical dwell time (DT) between the first and second electrical commands (S.sub.1, S.sub.2) belongs to the intermediate electrical dwell time range (Z).

2. The fuel injection system according to claim 1, wherein, in the intermediate electrical dwell time range, the total fuel amount (V) injected in the fuel injection phase is substantially constant.

3. The fuel injection system according to claim 1, wherein, in the intermediate electrical dwell time range, the total fuel amount (V) injected in the fuel injection phase does not vary more than 3 mm.sup.3 on a time basis of 40 .mu.s, in applications on passenger motor vehicle engines, and more than 6 mm.sup.3 on a time basis of 60 .mu.s, in applications on industrial motor vehicle amount.

4. The fuel injection system according to claim 1, wherein in the intermediate electrical dwell time range, the total fuel amount (V) injected in the fuel injection phase has a variation that is at least four times lower than the variation in the first and second electrical dwell time ranges.

5. The fuel injection system according to claim 1, wherein the electrical dwell time (DT) between the first and second electrical commands (S.sub.1, S.sub.2) is such that the main fuel injection (M) starts without interruption with respect to the pilot fuel injection (P), substantially at the instant in time in which the latter terminates.

6. The fuel injection system according to claim 1, wherein the fuel electroinjector (1) comprises a metering servo valve (9) including: a control chamber (12) designed to be supplied with fuel and having a fuel outlet (14); an open/close element (15) movable along opening and closing strokes to open and respectively close the fuel outlet (14); urging means designed to act on the open/close element (15) to close the fuel outlet (14); and an electric actuator (10) designed to act on the open/close element (15) against the action of the urging means to open the fuel outlet passage (14).

7. The fuel injection system according to claim 1, wherein it is a common rail fuel injection system.

8. A fuel electroinjector (1) for a fuel injection system (2) according to claim 1.

9. An electronic control unit (11) for a fuel injection system (2) according to claim 1.

10. A software loadable in an electronic control unit (11) of a fuel injection system (1) and designed to cause, when executed, the electronic control unit (11) to become configured as claimed in claim 1.

11. A method of controlling fuel injection in an internal combustion engine equipped with a fuel injection system (2) comprising:

at least one fuel electroinjector (1); and an electronic control unit (11) designed to supply the fuel electroinjector (1), in a fuel injection phase in an engine cylinder, with at least a first electrical command (S.sub.1) to perform a pilot fuel injection and a second electrical command (S.sub.2) to perform a main fuel injection, the first and second electrical commands (S.sub.1, S.sub.2) being separated in time by an electrical dwell time (DT) such that the main fuel injection (M) starts without interruption with respect to the pilot fuel injection (P); the fuel injection control method comprising the steps of:

characterizing a fuel electroinjector (1) to determine the total fuel amount (Q) injected during the pilot and main fuel injections (P, M) in a fuel injection phase in an engine cylinder as a function of the electrical dwell time (DT) between the first and second electrical commands (S.sub.1, S.sub.2);

checking whether the total fuel amount (Q) has, as the electrical dwell time (DT) between the first and second electrical commands (S.sub.1, S.sub.2) varies within an intermediate electrical dwell time range (Z) defined between a first and a second electrical dwell time range and such that the main fuel injection (M) starts without interruption with respect to the pilot fuel injection (P), a variation smaller than the variation in the first and second electrical dwell time ranges; and, if the check has a positive outcome, choosing the electrical dwell time (DT) in the intermediate electrical dwell time range (Z).

12. The fuel injection control method according claim 11, wherein, in the intermediate electrical dwell time range (Z), the total fuel amount (V) injected in the fuel injection phase is substantially constant.

13. The fuel injection control method according to claim 11, wherein, in the intermediate electrical dwell time range (Z), the total fuel amount (V) injected in the fuel injection phase does not vary more than 3 mm.sup.3 on a time basis of 40 .mu.s, in applications on passenger motor vehicle engines, and 6 mm.sup.3 on a time basis of 60 .mu.s, in applications on industrial motor vehicle engines.

14. The fuel injection control method according to claim 11, wherein the fuel electroinjector (1) is such that, in the intermediate electrical dwell time range (Z), the total fuel amount (V) injected in the fuel injection phase has a variation that is at least four times lower than the variation in the first and second electrical dwell time ranges.

15. The fuel injection control method according to claim 11, wherein the electrical dwell time (DT) between the first and second electrical commands (S.sub.1, S.sub.2) is such that the main fuel injection (M) starts without interruption with respect to the pilot fuel injection (P), substantially at the instant in which the latter terminates.

* * * * *